US005938253A

United States Patent [19]

Szablewski et al.

[11] Patent Number: 5,938,253

[45] Date of Patent: Aug. 17, 1999

[54] MOTOR VEHICLE GATE LOCK, ESPECIALLY TAILGATE LOCK

[75] Inventors: Piotr Szablewski; Siegfried Karge, both of Wuppertal, Germany

[73] Assignee: Robert Bosch GmbH, Stuttgart, Germany

[21] Appl. No.: 08/894,226

[22] PCT Filed: Feb. 14, 1996

[86] PCT No.: PCT/EP96/00641

§ 371 Date: Oct. 20, 1997

§ 102(e) Date: Oct. 20, 1997

[87] PCT Pub. No.: WO96/26341

PCT Pub. Date: Aug. 29, 1996

[30] Foreign Application Priority Data

Feb. 20, 1995 [DE] Germany ..... 195 05 779

[51] Int. Cl.[6] ..... E05C 3/06

[52] U.S. Cl. ..... 292/216; 292/201; 292/DIG. 23; 292/DIG. 43

[58] Field of Search ..... 292/216, 201, 292/DIG. 23, DIG. 43; 70/26, 257, 282

[56] References Cited

U.S. PATENT DOCUMENTS

| | | | |
|---|---|---|---|
| 4,518,180 | 5/1985 | Kleefeldt et al. | 292/201 |
| 4,664,430 | 5/1987 | Bernard | 292/201 |
| 5,020,838 | 6/1991 | Fukumoto | 292/201 |
| 5,238,274 | 8/1993 | Becker et al. | 292/201 |
| 5,632,515 | 5/1997 | Dowling | 292/216 |
| 5,673,578 | 10/1997 | Roos | 70/264 |
| 5,697,237 | 12/1997 | Dilger et al. | 70/264 |

FOREIGN PATENT DOCUMENTS

| | | |
|---|---|---|
| 2554898 | 11/1983 | France . |
| 3242527 | 5/1984 | Germany . |
| 39 32 268 | 6/1990 | Germany . |
| 40 15 552 | 11/1991 | Germany . |
| 2 112 443 | 7/1983 | United Kingdom . |

*Primary Examiner*—Steven Meyers
*Assistant Examiner*—Clifford B Vaterlaus
*Attorney, Agent, or Firm*—Sixbey, Friedman, Leedom & Ferguson; David S. Safran

[57] ABSTRACT

A motor vehicle gate lock having a lock catch (2) which can be shifted from an open position into a catch position and vice versa, a detent pawl (5) which holds the lock catch (2) in the catch position by catching, and a spring (7) which pretensions the lock catch (2) and detent pawl (5) relative to one another. The detent pawl (5) has an actuating surface (11) for the lock catch (2) at a distance from a catch projection (9) of the detent pawl. There is an electric motor drive (13) with a drive element (14) and a driving lug (16) that located off-center relative to the axis of rotation of the drive element. The driving lug (16) touches the actuating surface (11) by rotation of the drive element (14) in one direction and then lifts the catch projection (9) of the detent pawl (5) out of a catch projection (10) of the lock catch (2) which, in the open position, keeps the detent pawl (5) in a raised position. The electric motor drive (13) turns the drive element (14) in only one direction, so that it is not reset by spring force. The driving lug (16), after the detent pawl (5) has been raised, runs past the actuating surface (11). The detent pawl (5), viewed in the direction in which driving lug (16) moves, has a driver stop surface (18), at a distance behind the actuating surface (11), which is in the path of motion of the driving lug (16) and stops it, when the detent pawl (5) is in the raised position, but when detent pawl (5) is in the lowered position, it is outside of the path of motion of driving lug (16). The electric motor drive (13) is turned off by the driving lug (16) engaging the stop surface (18).

6 Claims, 4 Drawing Sheets

MOTOR VEHICLE GATE LOCK, ESPECIALLY TAILGATE LOCK

BACKGROUND OF THE INVENTION

1. Field of the Invention

The invention relates to a motor vehicle gate lock, especially a tailgate lock having a lock catch which can be shifted from an open position into a catch position and vice versa, and a detent pawl which holds the lock catch in the catch position by catching and which has an actuating surface for the lock catch at a distance from a catch projection. More specifically, the invention relates to such a motor vehicle gate lock which also has an electric motor drive with a drive element and a driving lug located off-center thereto, the driving lug touching the actuating surface of the detent by rotation of the drive element in one direction for lifting the catch projection of the detent pawl out of the catch projection of the lock catch, the lock catch keeping the detent pawl in a raised position when it is in the open position.

2. Description of Related Art

The known motor vehicle gate lock on which the invention is based (German Patent 39 32 268) is suitable as a gate lock, especially for a tailgate or rear door, but also as a hood lock or door lock. In the prior art, it is explained using the example of a tailgate lock or rear door lock. These motor vehicle locks, which are operated with an electric motor opening drive, are especially important in fact for rear doors of station wagons, but also for tailgates of standard sedans.

In the known motor vehicle gate lock, there is an elastic stop for the detent pawl in its raised position. As soon as the detent pawl has reached the elastic stop, and thus its up position, the electric motor drive is turned off. The drive element, which is made as a disk and which represents the worm wheel of an electric motor worm drive, is turned around its axis of rotation by a pretensioned reset spring in the backwards direction, and in this way, is returned to its initial position. The driving lug thus returns, with the reverse running direction, to its initial position on the same path on which it has approached the actuating surface of the detent pawl as it moves away and has moved the pawl into the up position. If the tailgate is then closed, the lock latch releases the detent pawl so that it can return to the lowered position under the action of the springs located between the two.

In the above described motor vehicle gate lock, the electric motor drive must lift not only the detent pawl but, at the same time, it must also tension the reset spring of the worn wheel. Therefore, it must be made accordingly strong.

From the prior art, a corresponding motor vehicle gate lock or motor vehicle door lock is known (Published German Application 32 42 527) in which lifting of the detent pawl by means of an eccentric driving lug takes place such that the drive element always turns in only one direction, and therefore, is not set back, the driving lug, after the detent pawl has been raised, running past its actuating surface. Therefore, here, the driving lug does not return to its initial position in a backwards motion, but runs through a complete 360 degree arc back into its initial position; when the latter is reached, a microswitch turns off the electric motor drive.

In the initially explained prior art, it is feasible for the disengagement of the electric motor drive to be triggered by monitoring the power consumption of the electric motor drive as soon as the detent pawl strikes the elastic stop. This is a better idea than using microswitches which can always fail.

SUMMARY OF THE INVENTION

The object of the invention is to configure and develop the initially explained, known motor vehicle gate lock, especially a tailgate lock, such that it works without the necessity of a reset spring and with stopping control of the electric motor being achieved with microswitches.

The aforementioned object is achieved by having the electric motor drive turns the drive element in only one direction so that the drive element is not reset by spring force, and the driving lug running past the actuating surface on detent pawl after the detent pawl has been raised. Viewed in the direction in which driving lug moves, at a distance behind the actuating surface, there is a driver stop surface which, when the detent pawl is in the raised position, is in the path of motion of the driving lug and stops it, but which is outside of the path of motion of the driving lug when the detent pawl is in its lowered position. Electric motor drive is turned off by the driving lug touching the stop surface.

According to the invention, it has been recognized that the detent pawl held actively in its raised position by the lock catch in its open position can, itself, easily form the stationary stop face which is necessary for stopping operation of the electric motor drive. While recently in the prior art the elastic stop for the detent pawl provides the driver stop surface on the actuating surface of the detent pawl, which however necessitates return motion of the driving lug, it has been recognized according to the invention that a driver stop surface which acts exactly oppositely can be accomplished by the stop surface of the detent pawl on the lock catch. To do this, this stop surface need simply be transferred into the path of movement of the driving lug so that, consequently, it must be formed on the detent pawl in this path of motion.

When the driving lug strikes this stop surface, the power consumption of the electric drive motor increases, and after a certain delay time, it can be turned off. If the lock catch then returns again to the catch position when the tailgate is closed, the detent pawl then returning to the lowered position, the driver stop surface moves out of the path of motion of the driving lug and therefore no longer blocks it. In the next opening process, the driving lug can, therefore, continue to turn unhindered in its working direction by means of the drive element.

The above described design entails a danger if the electric motor drive should fail for any reason. If the driving lug then is randomly located above the driver stop surface on the detent pawl, the latter can no longer be moved by emergency manual actuation into the raised position. One solution of this problem is for the driving lug to be movable relative to the drive element over an arc limited to a small angle, for the drive element to have a clearance cut which allows this relative motion of the driving lug and for the driving lug to be pre-tensioned by means of a spring into an end position which leads in the direction in which drive element turns. In this way, when striking the driver stop surface (but also the actuation surface), the driving lug will remain stationary against the action of spring force relative to the drive element, and the latter will therefore continue to move over a certain segment until the interlocking between the driving lug and drive element then stops this continued motion. Only then is the electric motor drive turned off. If now the detent pawl returns to the lowered position when the tailgate is closed, the driving lug moves on automatically under the action of spring force to a point on the other side of the location of the driver stop surface on the detent pawl. The angle of the arc must be dimensioned accordingly. Likewise, as now takes place with the electric motor drive during the next actuation, blocking of the detent pawl for emergency mechanical actuation is precluded in any case.

In the following the invention is detailed using a drawing which shows only one embodiment.

DETAILED DESCRIPTION OF THE PREFERRED EMBODIMENT

In the following, the invention is described using the example of a motor vehicle tailgate lock; but, it should be understood that the invention is not restricted to this use, and is also applicable to all other gate locks, hoods locks or door locks on motor vehicles.

Figure 1:
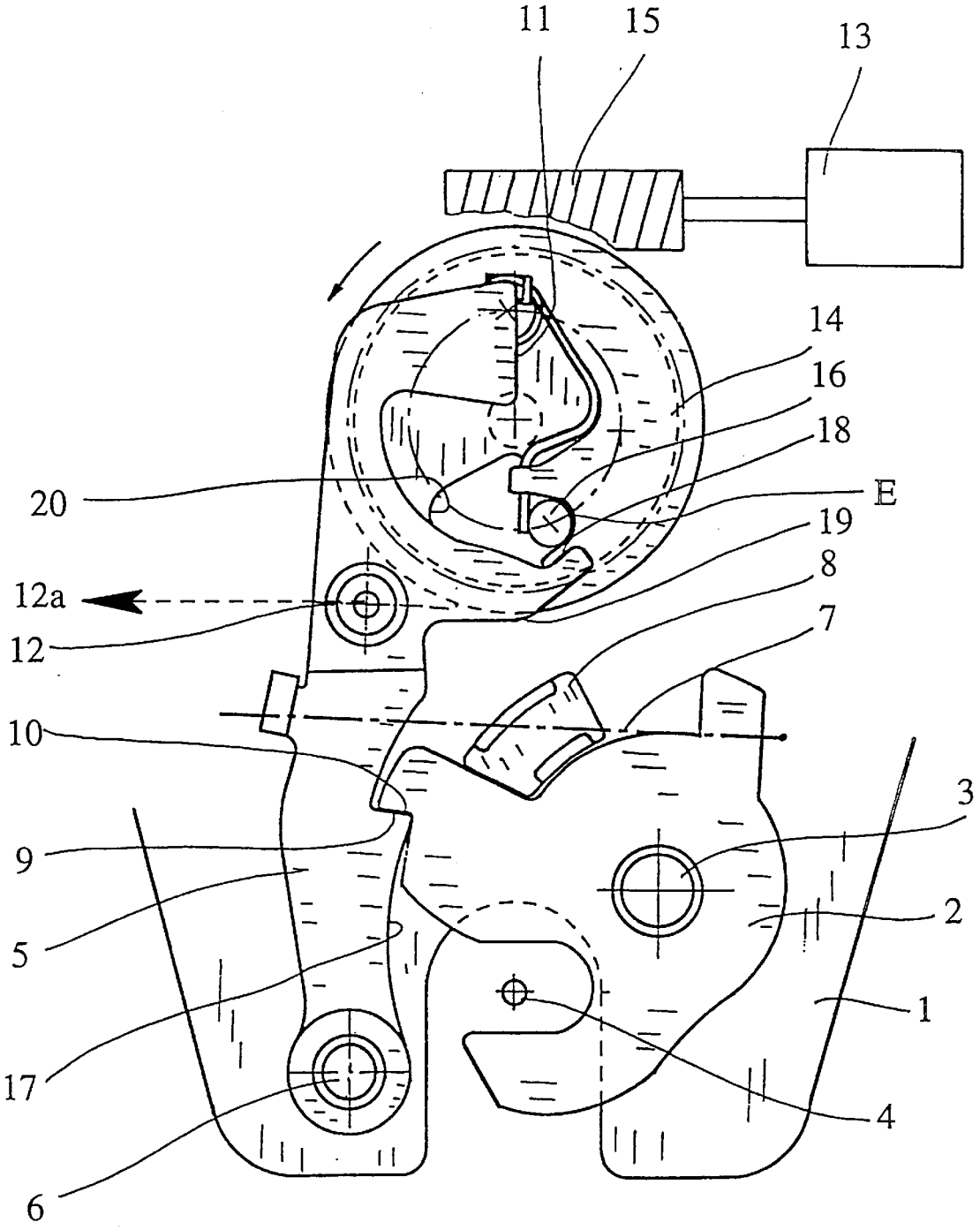
FIG. 1 shows one especially preferred embodiment of a motor vehicle tailgate lock in accordance with the invention in the initial position, specifically in the catch position of the lock catch, the electric drive motor being turned off.

FIG. 1 shows, first of all, a lock housing 1 in which is supported a lock catch 2 in the form of a rotary catch disposed on a bearing axis 3. A closing shackle 4 is shown which is encompassed within a fork opening of the lock catch 2 when the tailgate is closed.

In the catch position shown, lock catch 2 is held by a detent pawl 5, which is shown in FIG. 1 in its lowered position. Detent pawl 5 can be swivelled around a bearing axle 6 which is at bottom left in the embodiment shown. Detent pawl 5 and lock catch 2 in the preferred embodiment shown are pre-tensioned relative to one another by means of a spring 7. Also shown is a rubber-elastic buffer element 8 for the two end positions of lock catch 2, therefore the catch position and the open position. Lock catch 2, itself, can be jacketed with a rubber-elastic material.

Detent pawl 5 holds lock catch 2 in the catch position by means of catch projection 9, to which an appropriate catch projection 10 on the lock catch 2 corresponds. In this embodiment of a tailgate lock, lock catch 2 has only one main catch, catch projection 10. There are, of course, also versions with a main catch and a front catch on lock catch 2.

At a distance from catch projection 9, detent pawl 5 has an actuating surface 11. In addition, on detent pawl 5, there is a connection point 12 for an emergency opening element 12*a*, which is used for emergency mechanical/manual opening from the standpoint of a closing cylinder. Pulling, to the left in FIG. 1, on the emergency opening element 12*a* causes detent pawl 5 to be lifted from lock catch 2.

An electric motor drive 13, with a drive element 14 made as a disk (worm wheel in the embodiment shown) and driving spindle 15, is only diagrammatically shown in FIG. 1. Drive element 14 is equipped with an off-center driving lug 16 which, together with drive element 14, forms a type of crank drive. All of this is known from the prior art.

The solid line arrow in FIG. 1 indicates the direction of rotation of drive element 14 and the direction of motion of driving lug 16.

Figure 2:
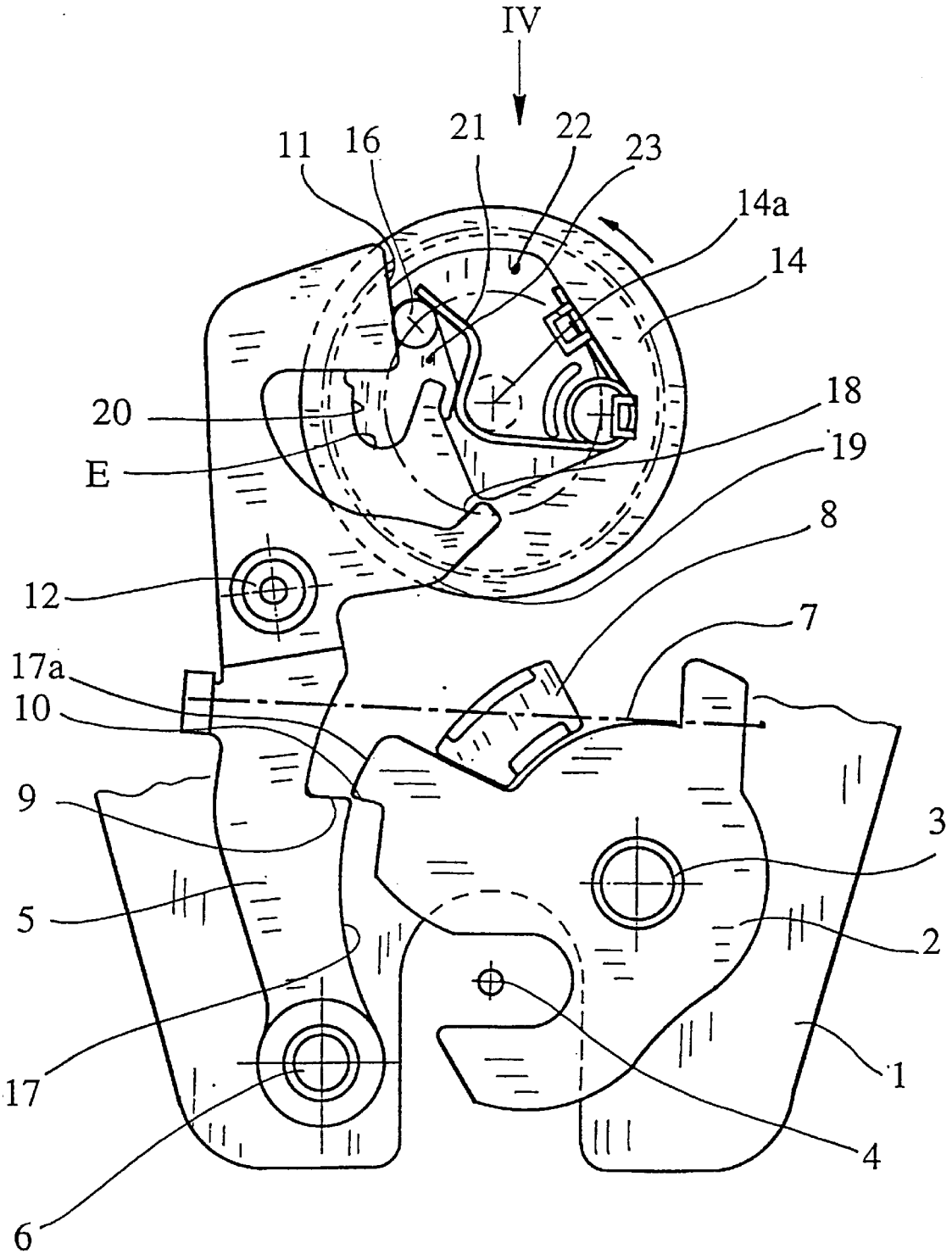
FIG. 2 shows the lock from FIG. 1 when the detent pawl reaches the raised position, the lock catch beginning the opening swivel stroke.

Comparison of FIGS. 1 and 2 shows that driving lug 16 touches actuating surface 11 by rotation of drive element 14 in the direction shown by the arrow, and thus, swivels detent pawl 5 around its bearing axle 6 in a counterclockwise direction. In this way, the catch projection 9 of detent pawl 5 is lifted out of catch projection 10 of lock catch 2. FIG. 2 shows this position.

Figure 3:
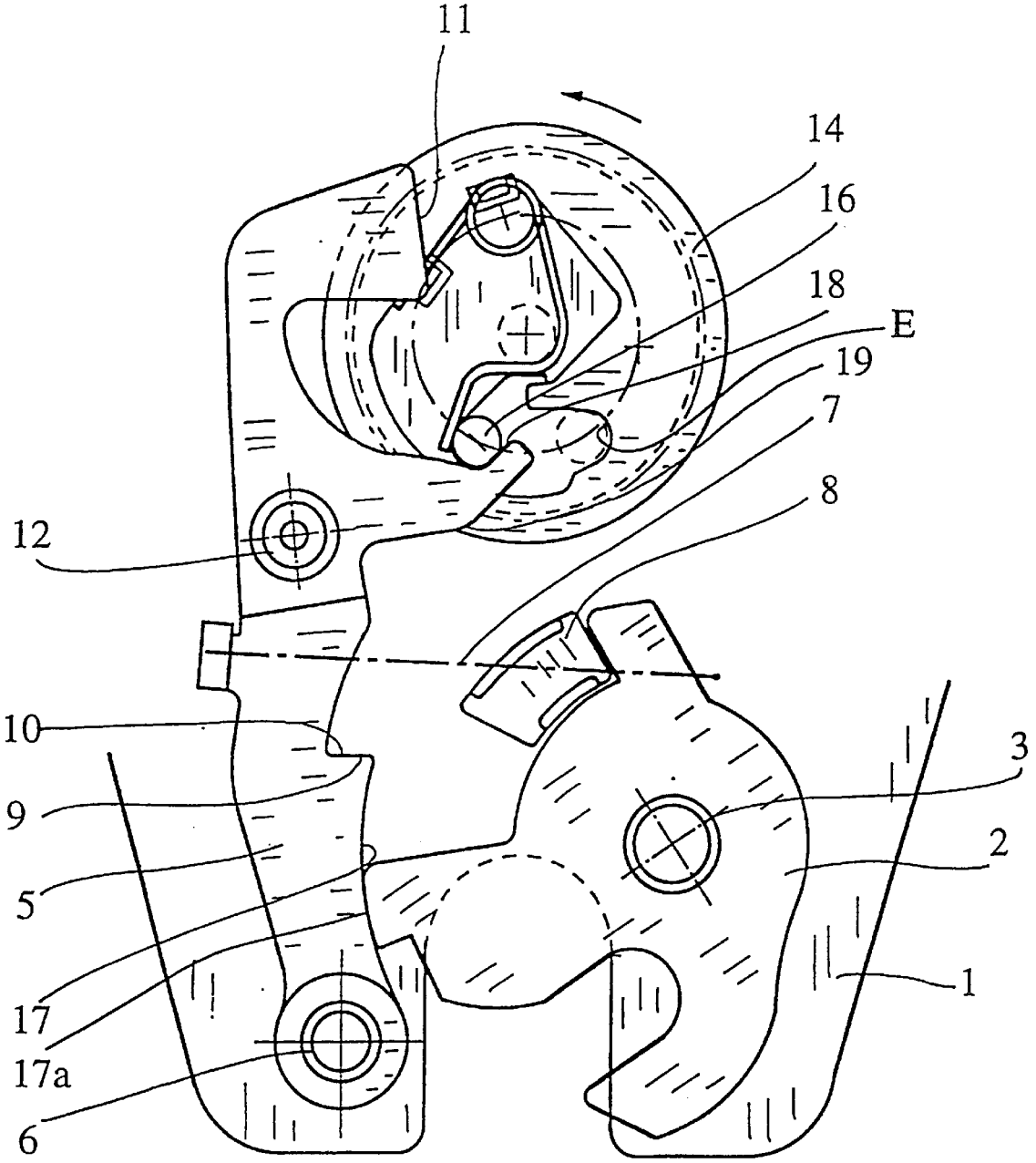
FIG. 3 shows the lock from FIG. 1, now with the lock catch in the open position and the detent pawl in the raised position, the driving lug on the driver stop s face, and the electric motor drive turned off.

FIG. 3 shows that lock catch 2, which is in the open position, keeps detent pawl 5 in the raised position, for this reason a retaining surface 17, which is supported on an opposite surface 17*a* on the leg of lock catch 2, is formed in the conventional manner on detent pawl 5.

FIG. 1, FIG. 2 and FIG. 3, in conjunction, show that electric motor drive 13 turns drive element 14 in only one direction, and therefore, drive element 14 is not returned, not even by spring force, that the driving lug 16, after detent pawl 5 has been raised, runs past actuating surface 11, that, on detent pawl 5, viewed in the direction in which driving lug 16 moves, at a distance behind actuating surface 11, there is a driver stop surface 18 which, when detent pawl 5 is in the raised position, is in the path of motion of driving lug 16 and stops it (FIG. 3), but when detent pawl 5 is in the lowered position is outside of the path of motion of driving lug 16 (FIG. 1), and that electric motor drive 13 is turned off by driving lug 16 touching stop surface 18. Driving lug 16, therefore, forces detent pawl 5 into a slight overstroke above and beyond the actual raised position in order to run past actuating surface 11. This ensures that lock catch 2 also in fact opens without problems.

FIG. 3 makes it clear that, by means of the swivel motion of detent pawl 5 around its bearing axis 6 in a counterclockwise direction, detent pawl arm 19 with driver stop surface 18 is swivelled into the path of motion of driving lug 16. After being stopped for a few hundred milliseconds on this drive stop surface 18, electric motor drive 13 is turned off. Microswitches can be abandoned by this blocking of operation of electric motor drive 13. At the same time, the return spring necessary in the prior art in the conventional two-stage worm drive can also be abandoned. Electric motor drive 13 can therefore be made much less powerful than in the prior art, since it need move only detent pawl 5.

In all motor vehicle locks provided with servo drives, failure of the electric motor drive is a special problem. For this reason, there is a connection point 12 for emergency opening. If however electric motor drive 13, in the position shown in FIG. 2 or a position somewhat more forward in the direction of rotation shown, should lock, detent pawl 5 could no longer return to its lowered position. Accordingly, it holds that locking of electric motor drive 13 in a position with driving lug 16 between the positions shown in FIG. 1 and FIG. 3 would lead to detent pawl 5 being completely blocked, therefore emergency mechanical opening would no longer be possible.

To solve this problem, in the embodiment shown, it is now provided that driving lug 16 can move relative to drive element 14 over an arc limited to a small angle, preferably an angle of 45°, that drive element 14 has a clearance cut 20 which allows this relative motion of driving lug 16, and that driving lug 16 is pre-tensioned by means of spring 21 into an end position E which leads in the direction in which drive element 14 turns. Clearance cut 20 can be made as an arc-shaped longitudinal hole or also as a circular cutout open on the peripheral side or can also have some other functionally appropriate form as is shown in this embodiment. Spring 21 is a bending spring here.

Figure 4:
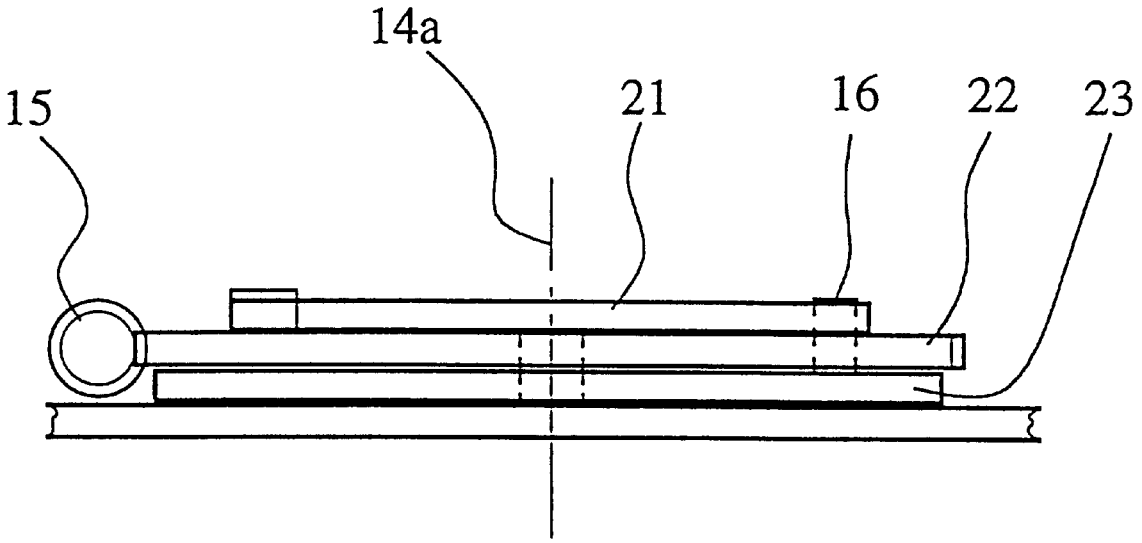
FIG. 4 shows the drive element in a view taken in the direction of the arrow IV in FIG. 2.

Driving lug 16 can be located, for example, exposed with an annular flange in a circular arc-shaped longitudinal hole, pre-tensioned simply by spring 21 in the direction of end position E. The preferred embodiment shown, however, illustrates another special design in which the drive element 14 has two partial elements 22, 23 which are located in succession in the direction of its longitudinal axis 14*a* and that partial element 22 is permanently coupled to electric motor drive 13 and has clearance cut 20 and the other partial element 23 bears driving lug 16. This design shown in FIG. 4, with division of disk-shaped drive element 14 into two coaxial partial elements 22, 23, is known in a servo drive for a motor vehicle door lock, even if in a different connection (Published German Application 40 15 522). It is a design which is structurally simple to accomplish.

Comparison of FIGS. 3 and 1 makes it clear that, by means of spring loading of driving lug 16, the lug first touches stop surface 18, but still without direct action on drive element 14. The latter first continues to run, electric motor drive 13 continues to turn it in the direction of the arrow, driving lug 16 deflects under the loading of spring 21, therefore simply remains stationary on stop surface 18. Only when the backward end of clearance cut 20 (therefore the trailing end) is reached does interlocking occur between driving lug 16 and drive element 14 and the electric motor drive 13 runs into the block. At this point, electric motor drive 13 switches off after a set delay time.

If at this point detent pawl 5 returns to the lowered position shown in FIG. 1, detent pawl arm 19 with driver stop surface 18 releases driving lug 16. The latter snaps under the action of spring 21 in the direction of the arrow into end position E, therefore the leading end of clearance cut 20 (as shown by cross hatching in FIG. 3). Therefore, driving lug 16 has passed the critical position with blocking of detent pawl arm 19 under spring force, therefore without starting of electric motor drive 13. Failure of electric motor drive 13 is therefore not critical in any case. The same applies otherwise, as FIG. 2 illustrates in conjunction with FIG. 1, also to driving lug 16 running past actuating surface 11 of detent pawl 5.

We claim:

1. Motor vehicle gate lock comprising:

a lock catch having a catch projection, said catch being shiftable from an open position into a catch position and from said catch position to said open position;

a detent pawl, said detent pawl having a catch projection that holds the lock catch in the catch position by catching in a lowered position of the detent pawl and having an actuating surface for the lock catch which is at a distance from the catch projection;

an electric motor drive with a drive element and a driving lug, the driving lug being located off-center relative to an axis of rotation of the drive element and engaging the actuating surface of the detent pawl, due to rotation of drive element in one direction, and lifting the catch projection of the detent pawl, from said lowered position, out of the catch projection of the lock catch into a raised position, said lock catch, in said open position thereof, keeping the detent pawl in said raised position;

wherein said drive element is rotatable by the electric motor drive in only one direction; wherein the driving lug, after the detent pawl has been raised, is able to run past the actuating surface of the detent; wherein a driver stop surface is provided on the detent pawl at a distance after the actuating surface, viewed in a path of motion along which the driving lug moves in said one direction of rotation of the drive element, said driver stop surface, when the detent pawl is in the raised position, being in the path of motion of the driving lug for stopping the driving lug, and being out of said path of motion when the detent pawl is in the lowered position; wherein electric motor drive is turned off in response to engagement of the driving lug with the stop surface; and wherein the driving lug is movable relative to the drive element over an arc limited to an acute angle within a clearance cut of the drive element; and wherein the driving lug is pre-tensioned by means of a spring into an end position of the clearance cut which is a leading end in the direction in which drive element moves the driving lug along said path of motion.

2. Motor vehicle gate lock as claimed in claim 1, wherein the drive element has two partial elements which are located in succession in a direction of the axis of rotation of the drive element; wherein a first of said partial elements is permanently coupled to the electric motor drive and has the clearance cut; and wherein the other of said partial elements bears the driving lug.

3. Motor vehicle gate lock as claimed in claim 1, wherein a spring pretensions the lock catch and the detent pawl toward one another.

4. Motor vehicle gate lock as claimed in claim 2, wherein the partial elements of the drive element are each comprised of a disk.

5. Motor vehicle gate lock as claimed in claim 1, wherein the drive element comprises a disk.

6. Motor vehicle gate lock as claimed in claim 1, wherein the angle to which the arc is limited is an angle of 45°.

* * * * *